US005279787A

United States Patent [19]

Oltrogge

[11] Patent Number: 5,279,787

[45] Date of Patent: Jan. 18, 1994

[54] HIGH DENSITY PROJECTILE AND METHOD OF MAKING SAME FROM A MIXTURE OF LOW DENSITY AND HIGH DENSITY METAL POWDERS

[76] Inventor: Victor C. Oltrogge, 11178 W. 59th Pl., Arvada, Colo. 80004

[21] Appl. No.: 876,006

[22] Filed: Apr. 29, 1992

[51] Int. Cl.[5] ..... B22F 3/12; B22F 9/02

[52] U.S. Cl. ..... 419/38; 419/37

[58] Field of Search ..... 419/38, 47

[56] References Cited

U.S. PATENT DOCUMENTS

| | | | |
|---|---|---|---|
| 2,978,742 | 4/1961 | Bliemeister | 419/38 |
| 3,301,673 | 1/1967 | Bridwell et al. | 419/47 |
| 3,303,026 | 2/1967 | Zdanuk et al. | 419/38 |
| 3,310,400 | 3/1967 | Alexander et al. | 419/38 |
| 3,677,669 | 7/1972 | Bliemeister | 425/6 |
| 4,428,295 | 1/1984 | Urs | 102/448 |
| 4,836,978 | 6/1989 | Watanabe et al. | 419/10 |
| 4,892,861 | 1/1990 | Ray | 505/1 |
| 4,949,644 | 8/1990 | Brown | 102/498 |
| 5,114,469 | 5/1992 | Weiman | 75/235 |
| 5,167,697 | 12/1992 | Koumura et al. | 419/38 |

OTHER PUBLICATIONS

Beddow, John, "The Production of Metal Powders by Atomization," 1978, Heyden & Son Ltd., p. 26.

Eremenko, V. N., "Liquid-Phase Sintering," Institute of Materials Science, 1970, p. 7.

*Primary Examiner*—Donald P. Walsh
*Assistant Examiner*—Daniel Jenkins
*Attorney, Agent, or Firm*—John E. Reilly

[57] ABSTRACT

Numerous products can be formed by combining a low melting matrix made up of one or more metals and high melting, high density metal particles and wherein the products can be formed by adding the high density particles to a molten matrix metal and casting same, mixing powders of all the metals together, compacting and centering at a temperature in the low end of the melting range of the matrix alloy, or by mixing the high density particles into a paste of the matrix alloy and molding. These methods and compositions are particularly adaptable for use in forming low or non-toxic high density projectiles, such as, shot, bullets and pellets having a density comparable to that of lead while avoiding problems of toxicity associated with the use of lead.

24 Claims, 4 Drawing Sheets

HIGH DENSITY PROJECTILE AND METHOD OF MAKING SAME FROM A MIXTURE OF LOW DENSITY AND HIGH DENSITY METAL POWDERS

This invention relates to high density metal products and methods of making same; and more particularly relates to novel and improved variable density projectiles and to methods and apparatus for making same.

BACKGROUND AND FIELD OF THE INVENTION

Traditionally, shot for shotguns has been composed of lead by virtue of its high density and low melting point characteristics. In recent years, however, lead has fallen into disfavor owing to its toxicity. On the other hand, there are no satisfactory substitute metals possessing the same density characteristics, and those metals that are somewhat close to lead in density are not satisfactory substitutes as a result of other drawbacks, such as, high cost, radioactivity, high melting point or other properties. Accordingly, numerous attempts have been made to formulate a mixture of metals which would serve as satisfactory substitutes for lead and especially in the manufacture of shot, pellets, bullets and the like.

Among other approaches which have been proposed, U.S. Pat. No. 4,428,295 to V. Urs is directed to a high density shot made up of an unsintered, cold-compacted mixture of at least two metal powders, one of the powders being more dense than lead and a second one being about the density of lead and flowable under compaction to serve as a matrix that surrounds the denser unmelted powder. The patent to Urs in particular is representative of approaches which have been taken to achieve at least the density of lead by combining lead with the powder of a metal that is more dense than lead. Urs avoids sintering in combining or compacting the metals together, as a result of which the end product has cold welding lines with microscopic voids or air pockets along those cold welding lines which weaken the product. The term "sintering" as employed in the metallurgical industry is the treating of compacted metal powders by heating to an elevated temperature sufficient to cause diffusion without melting of any of the metals present. One difficulty in sintering a single low melting point metal is that temperature and time are hard to control to the required tolerances and, for example, heating even slightly above the melting point temperature can result in melting of the metal into a puddle. On the other hand, sintering of the low-melting-point metal is desirable from the standpoint of achieving higher values of density and strength of the resultant article, because sintering is more effective than compaction alone in causing the matrix to become continuous and avoid weld lines in the article.

U.S. Pat. No. 4,949,644 to J. E. Brown utilizes bismuth or a bismuth alloy in the formation of high density shot. However, achieving the density of lead in this manner is exceedingly difficult since bismuth is significantly less dense than lead, and to alloy bismuth with any of the few metals that are more dense than lead poses immense problems of toxicity, economy or high temperature processing.

SUMMARY OF THE INVENTION

It is an object of the present invention to provide for a novel and improved article of manufacture composed of metals and to provide a method of forming same over a wide range of densities to achieve a target density.

Another object of the present invention is to select a unique combination of low toxicity, low melting point metals and combine in such a way as to form a matrix that is itself capable of melting over a broad temperature range rather than at a specific melting point; and further to raise the density of the matrix alloy to the desired level with the addition of a powdered, low toxicity, high density, high melting point metal or metals.

Another object of the present invention is to provide for a novel and improved method and means for preparing high density metal products and specifically projectiles, such as, shot, bullets, pellets and the like which avoids the use of highly toxic metals but at the same time is able to duplicate the characteristics of metals, such as, lead in terms of density; and further wherein the density of each product may be varied or made non-uniform throughout its thickness.

It is a further object of the present invention to provide for a novel and improved combination of metals which is low in cost and can achieve a desired target density over an extremely wide range of densities and in such a way as to avoid the need for close control over the sintering temperature or the melting range of the metal components when combined and which maintains uniform distribution throughout the article of manufacture of the metal particles that do not participate in the sintering process.

It is a further object of the present invention to provide for a novel and improved method of combining metals of different densities which is low in cost, achieves a desired target density over an extremely wide range, and avoids the necessity of close control over the temperature or melting range of the metal components when combined.

It is a still further object of the present invention to provide for a novel and improved method of casting projectiles and other products from a melt of one or more low melting point metals or alloy containing unmelted particles of one or more high density high melting point metals.

An additional object of the present invention is to provide for a novel and improved method of combining low density metals with one or more high density metal powders in the formation of high density projectiles which will serve as an effective substitute for lead while avoiding the use of toxic materials and highly sophisticated or difficult manufacturing techniques and equipment.

In accordance with the present invention, a high density projectile is comprised of at least one metal having a density less than a predetermined target density level and one or more high melting point metal powders having a density greater than the target density level and dispersed in sufficient quantities throughout said low melting point metal(s) to form a resultant product having the target density level.

Different methods may be practiced in preparing articles of manufacture in accordance with the present invention. In a casting process, at least one low melting point metal is heated into the molten state just above the liquidus line of the metal or alloy, a high melting point metal introduced in powdered form and vigorously stirred, forming droplets of the resultant mixture and permitting the droplets to advance either through a zero gravity space or to fall through air or water or other fluid either with or without spin. In a powder metallurgy process, powders of the low melting point and high melting point metals are mixed, followed by compaction into the desired product shape and sintering to diffuse the low melting point metals into each other. In an alternative approach to the methods described above, two or more low melting point metals are combined to form an alloy system which is heated to a temperature above the liquidus line of the melting range of the alloy, cooling to a temperature just above the solidus line so that the alloy becomes pasty, introducing one or more high melting point metal powders having a density greater than the target density level in sufficient quantities to form a mixture possessing the target density when combined, followed by molding the resultant mixture into the desired configuration of the article, such as, by die casting.

The article of manufacture and method of making same according to my invention lend themselves extremely well to different end products, the characteristics of which can be best typified by describing their use in connection with the formation of projectiles, such as, rifle bullets, shot, pellets and the like. For instance, as applied to the manufacture of bullets, density can be a variable for the bullet designer while improving bullet performance, that is to say, improved velocity retention during the flight of the bullet. Similarly, shotgun pellets can be designed with different total densities and wherein the density can be controlled or varied throughout the thickness of the pellet so as to establish an off-center, center of gravity in a spherical pellet such that the heavy side of the sphere leads and the light side trails during flight. Other pellets can be made that accommodate aerodynamic factors, such as, pellets in the form of spheres with tails if necessary to add stability in flight. A conical tail, with or without the off-center center of gravity, is beneficial as compared to a sphere in producing a lower drag coefficient and good stability in flight.

Other objects, advantages and features of the present invention will become more readily appreciated and understood when taken together with the following detailed description of a preferred embodiment in conjunction with the accompanying drawings, in which:

DETAILED DESCRIPTION OF THE PREFERRED EMBODIMENT

Figure 1:
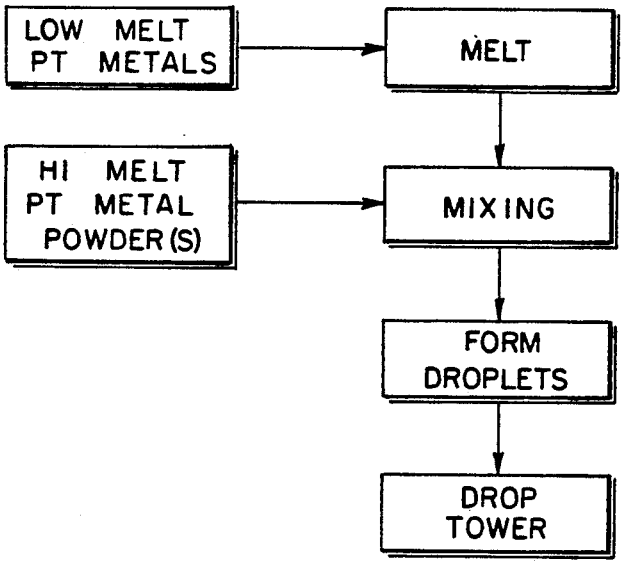
FIG. 1 is a flow diagram illustrating the sequence of steps in the preferred method which are followed in the manufacture of articles in accordance with the present invention.
Figure 2:
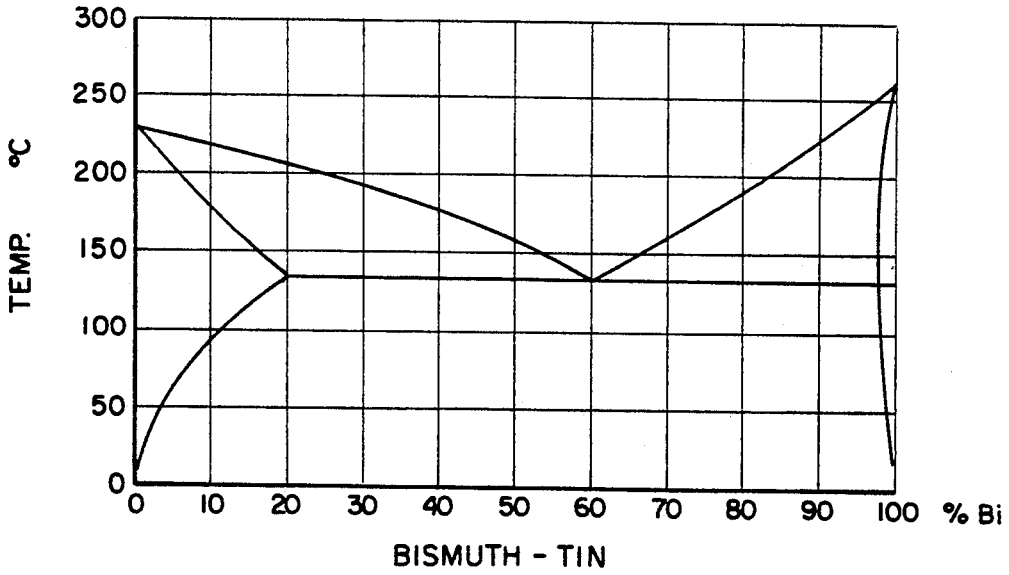
FIG. 2 is a phase diagram illustrating the eutectic nature of the bismuth-tin system and showing the solidus and liquidus lines.

Referring in more detail to the drawings, FIG. 1 illustrates the sequence of steps followed in the manufacture of high density metal products comparable to or greater than the density of lead. As a setting for the present invention, it may be best typified by describing its use in forming projectiles, such as, shot and wherein the density can be closely controlled according to the desired ballistics and other characteristics of the projectile. In the preferred method as illustrated in FIG. 1, step 1 illustrates the melting of a mixture of low melting point metals to a temperature above the liquidus line of the alloy, as illustrated in FIG. 2 for bismuth and tin. Typically, the two or more metals selected as components of the low melting matrix have a density less than the target density of the final product. Metals having the desired characteristics will be hereinafter identified along with typical combinations of same to produce a desired end product.

Once the matrix alloy is melted in accordance with the present invention, a high density high melting point metal powder is introduced in proportions by weight to the alloy so as to result in an end product having the target density. The high melting point metal is introduced in powdered form of the desired size or consistency and uniformly distributed by vigorously stirring without melting into the alloy, followed by forming into a droplet shape, as represented in step 3. The formation of droplets is hereinafter discussed in greater detail in conjunction with the preferred form of apparatus illustrated in FIGS. 11 and 12 and, insofar as the method is concerned, broadly comprises the subsequent step in step 4 of advancing the droplets through a drop tower and through different fluid media, with or without spin, to control the uniformity or distribution of density of the product. From the foregoing, variations in the relative proportions by weight of the metals can be made, particularly in the introduction of the high melting point powder, to produce a desired or target density; also a single low melting point metal can be melted and combined with one or more high density high melting metal powders as described.

EXAMPLE

A product was prepared by mixing as percentages by weight of the entire composition 44.49% by weight bismuth with 16.46% by weight tin, and melting in accordance with step 1 as shown in FIG. 1. The bismuth and tin constitute a low melting point alloy that has liquidus and solidus lines as shown in FIG. 2. The low melting point metals are preferably melted in particle or chunk form for economy reasons and are heated to a temperature above the liquidus temperature of the alloy and sufficient to cause the bismuth and tin to fuse into a continuous alloy in which the high melting point metal powder is to be introduced, as represented in step 2. Specifically, 39.04% by weight tungsten was introduced in powdered form and uniformly distributed by stirring into the molten alloy.

Different combinations cf metals can be selected to satisfy the requisites of a low melting point alloy having the desired density. Suitable low melting point metals may be formed from one or more of tin, antimony, zinc, indium, copper, bismuth, silver, arsenic, aluminum, cadmium, selenium and calcium. Table I below illustrates combinations of the metals tungsten, bismuth and tin that will yield a material having a density equal to the density of lead, which is 11.34 grams per cubic centimeter.

TABLE I

| | Weight Percent of: | | | |
|---|---|---|---|---|
| | Tungsten | Bismuth | Tin | Density gm/cc |
| A. | 39.05 | 44.49 | 16.46 | 11.34 |
| B. | 41.24 | 39.28 | 19.48 | 11.34 |
| C. | 47.04 | 25.03 | 27.93 | 11.34 |

TABLE II

| | Weight Percent of: | | | |
|---|---|---|---|---|
| | Tungsten | Bismuth | Tin | Density gm/cc |
| A. | 34.90 | 47.50 | 17.60 | 11.03 |
| B. | 47.90 | 38.10 | 14.00 | 12.06 |
| C. | 76.30 | 17.30 | 6.40 | 15.14 |

TABLE III

| | Weight Percent of: | | | |
|---|---|---|---|---|
| | Tantalum | Bismuth | Antimony | Density gm/cc |
| A. | 37.60 | 53.40 | 9.00 | 11.03 |
| B. | 42.80 | 48.90 | 8.30 | 11.34 |
| C. | 73.10 | 23.00 | 3.90 | 13.63 |
| D. | 84.50 | 13.30 | 2.20 | 14.74 |

TABLE IV

| | Weight Percent of: | | |
|---|---|---|---|
| | Tungsten | Bismuth | Density gm/cc |
| A. | 55.00 | 45.00 | 13.43 |
| B. | 65.00 | 35.00 | 14.40 |
| C. | 85.50 | 14.50 | 16.89 |

TABLE V

| | Weight Percent of: | | |
|---|---|---|---|
| | Tungsten | Tin | Density gm/cc |
| A. | 49.10 | 50.90 | 10.50 |
| B. | 57.40 | 42.60 | 11.34 |
| C. | 79.80 | 20.20 | 14.47 |
| D. | 88.75 | 11.25 | 16.27 |

TABLE VI

| | Weight Percent of: | | |
|---|---|---|---|
| | Tungsten | Lead | Density gm/cc |
| A. | 15.9 | 84.1 | 12.14 |
| B. | 42.1 | 57.9 | 13.71 |
| C. | 62.9 | 37.1 | 15.30 |
| D. | 83.6 | 16.4 | 17.27 |

TABLE VII

| | Weight Percent of: | | |
|---|---|---|---|
| | Tantalum | Tin | Density gm/cc |
| A. | 55.00 | 45.00 | 10.56 |
| B. | 63.50 | 36.50 | 11.34 |
| C | 75.00 | 25.00 | 12.59 |
| D. | 87.20 | 12.80 | 14.28 |

Table I above further illustrates how variations in each ingredient can nevertheless yield a single density, and for the purpose of illustration lead is chosen as the target density in the Table. Table II shows that other variations in the composition can achieve any target density within the limits of the density of the low melting point metal and the lack of interstitial spaces between the tungsten particles. Table III illustrates the use of another metal; namely, antimony and wherein bismuth and antimony together form an isomorphous alloy system. Tables IV through VII illustrate single metal matrix material used as a single low melting point metal.

Other metals may be added to the compositions in relatively minor amounts to achieve adjustment of hardness, crystalographic grain size, visual appearance, melt surface tension, modulus of elasticity or electric or magnetic properties of the product.

Examples of other high density metals which exceed the density of lead and which may be suitably employed in place of tungsten, or in addition to tungsten, are tantalum, iridium, osmium, rhenium, gold and their alloys.

Figure 3:
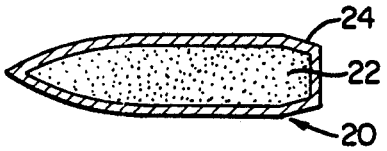
FIGS. 3 to 6 are cross-sectional views of different bullet configurations formed in accordance with the present invention.
Figure 4:
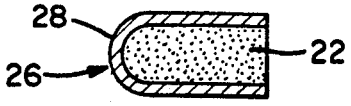
Figure 6:
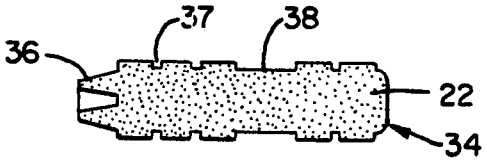
Figure 5:
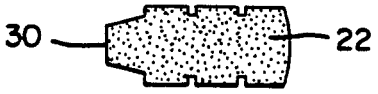

FIG. 3 illustrates a typical rifle bullet 20 containing a core composition 22 formed in accordance with the methods of the present invention and having an outer jacket 24 of conventional construction. FIG. 4 illustrates a typical pistol bullet 26 having a core material 22 shaped into a somewhat more snub-nosed configuration and encased in an outer jacket 28. FIGS. 5 and 6 illustrate typical non-jacketed bullets consisting only of a core material 22 in accordance with the present invention and which, for example, may be shaped to include a tapered end portion 30, and axially spaced circumferential grooves 31 are formed around the external surface of the bullet. FIG. 6 illustrates a typical rifle bullet 34 which is non-jacketed and made up entirely of the core material 22 formed into a somewhat more elongated configuration having a tapered end 36, and spaced circumferential grooves 37 include a wider groove 38 at an intermediate section of the bullet.

Figure 7:
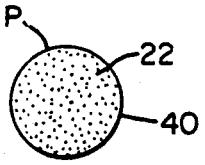
FIGS. 7 and 8 are cross-sectional views of spherical shot having different concentrations of high density particles therein.
Figure 8:
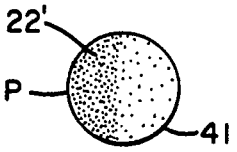

FIG. 7 illustrates a spherical shot pellet 40 composed entirely of the core material 22 and wherein high density tungsten particles or other high density particles are uniformly distributed throughout the pellet P. FIG. 8 illustrates another form of spherical shot pellet 41 containing core material 22' in which the high density metal particles are not uniformly distributed but are concentrated more along one side of the pellet P as illustrated. This results in an off-center center of gravity so as to lend stability to the pellet during its flight. Thus, the heavier side of the sphere will lead and the lighter side trail.

Figure 9:
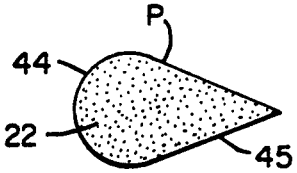
FIG. 9 is a cross-sectional view of a shot having a conical tail portion.

In FIG. 9, a shot 44 is illustrated having a generally spherical end 44 and a conical tail portion 45 and wherein the core material 22 contains a selected concentration of high density particles P, according to the density requirements of the shot.

Figure 10A:
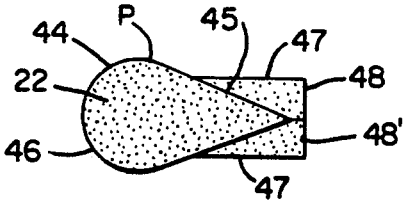
FIG. 10A is a cross-sectional view of a shot having a conical tail portion with aerodynamic fins thereon.
Figure 10B:
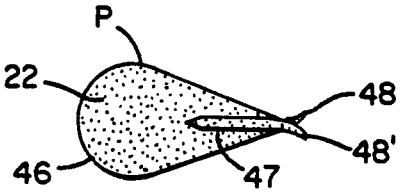
FIG. 10B is another view partially in section of the shot illustrated in FIG. 10A and taken at right angles thereto.

FIGS. 10A and 10B illustrate the shaping of a shot pellet 46 to include a spherical end 44 and conical tail portion 45, as illustrated in FIG. 9, and composed entirely of the core material 22 with high density particles P distributed throughout according to the desired ballistics and density of the pellet 46. In addition, a pair of fins 47 are disposed in diametrically opposed relation to one another on the conical tail portion 45 and which are composed of the core material 22 with high density particles P so as to form a unitary part of the pellet. Preferably, the fins 47 include trailing edges 48 and 48' which are angled as shown in FIG. 10B in opposite directions away from a common plane passing through the fins 47.

In forming pellets of the type illustrated and described in conjunction with FIG. 7, moldless casting has been practiced for casting of lead shotgun shot in a drop tower. Droplets of molten lead are dropped through the air for a sufficient distance to freeze before striking the surface of a water-filled system. This technique, often combined with the addition of arsenic to increase the surface tension of the molten droplets, can be used to produce spherical shot. For example, U.S. Pat. Nos. 2,978,742 and 3,677,669 to Bliemeister employ this principle to form shot by permitting the shot to fall through water thus requiring a shorter vertical distance. However, drag in water is much greater than in air so as to cause the shot to deform and, by adding or introducing spin as it falls through the water, will minimize distortion of the shot.

Figure 11:
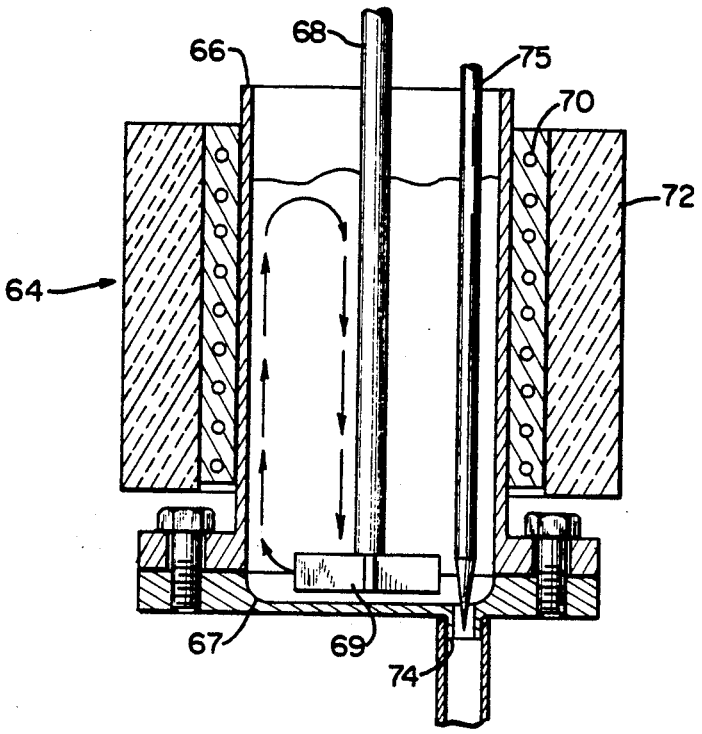
FIG. 11 is a somewhat schematic view of a preferred form of crucible for forming shot in accordance with the present invention.

Apparatus for producing shot in accordance with the method described and shown in FIG. 1 is illustrated in FIG. 11 and which is comprised of a first crucible 64 including a single cylinder 66 having a lower closed end 67 and a central vertical-blade impeller 68 with blades 69 mounted for rotation within the cylinder 66. The low melting point metals, such as, bismuth and tin may be melted separately and mixed in proper proportions followed by placing in the crucible of FIG. 11 and retained in a molten state. The powdered high melting point metal, such as, tungsten is introduced into the crucible and intimately mixed with the low melting point metals by rapidly stirring with the impeller 68. The impeller 68 is most desirably of substantially lesser diameter than that of the cylinder 66 and the flow of the melt with entrained high density metal particles is in the direction of the arrows wherein the melt advances in an axial direction downwardly along the shaft, then is expelled outwardly by the impeller blades 69 and thence to flow upwardly along the wall of the cylinder 66. Heating elements 70 and outer surrounding insulation 72 are provided to maintain the temperature of the melt. At one or more points along the flat bottom surface 67 of the cylinder 66, apertures 74 each receive the lower tapered end of a needle valve 75 and wherein the needle valve is reciprocated in a vertical direction to successively close and open each associated aperture 74 to permit gravity flow of the molten material and entrained high density, high melting point, unmelted particles from the lower end of the crucible 65 through a tube associated with each aperture 74 for introduction into crucible 49 shown in FIG. 12.

Figure 12:
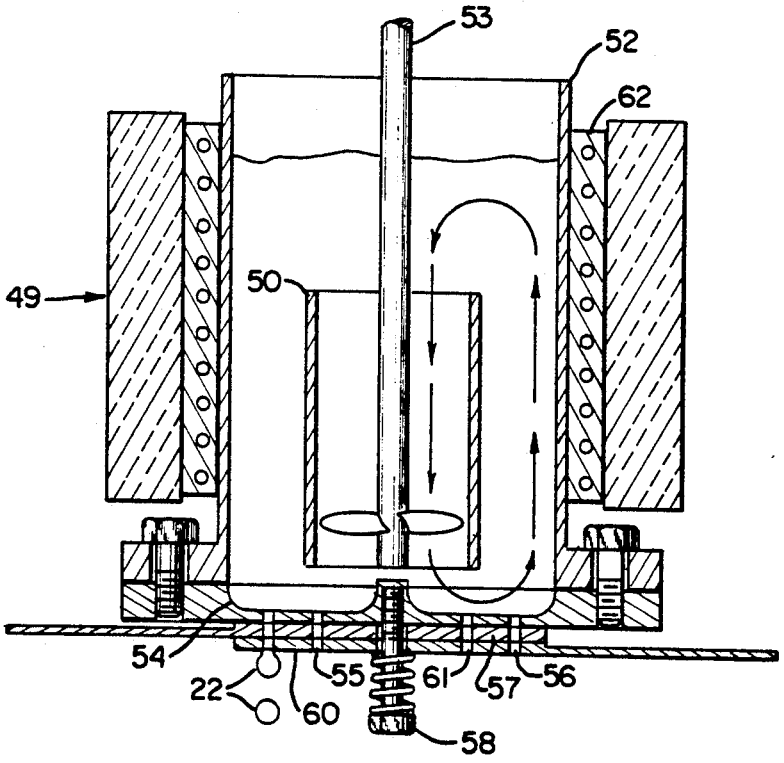
FIG. 12 is another somewhat schematic view of a crucible used in conjunction with that of FIG. 11 in forming shot.

Referring to FIG. 12, a second crucible 49 has an inner cylinder 50 positioned in inner, spaced concentric relation to an outer cylinder 52 to establish flow through the inner cylinder 50 and through the annulus between the cylinders 50 and 52. A central impeller 53 drives the contained materials which have been maintained in the molten stage with entrained, unmelted metal powder as described downwardly through the inner cylinder 50 followed by upward flow through the annulus between the cylinders as shown, over the top of the inner cylinder 50 to return downward therethrough. The outer cylinder 52 includes a lower closed end 54 which is generally cup-shaped as shown to establish a uniform flow between the inner and outer cylinders 50 and 52 as the melt is advanced from the lower end of the cylinder. In this way, the solid high density, high melting point particles introduced into the molten metal will be uniformly distributed throughout the melt and not tend to accumulate toward the bottom of the cylinder. Apertures 55 extend through the lower closed end 54 of the outer cylinder and communicate with openings 56 in a thin valve plate 57 which rotates about a center shaft 58 aligned with the impeller 53. Rotation of the valve plate 57 causes movement of the openings 56 into and out of alignment with the apertures 55 in the cylinder to allow or disallow flow of material out of the cylinder 52. Oscillator plate 60 bears against the bottom of the valve plate 57 and is rotatable about the center shaft 58, and the plate 60 is provided with holes 61 which are maintained in alignment with the openings 55 in the cylinder 52. The oscillator plate may be oscillated or vibrated by a conventional vibrator of adjustable frequency and amplitude rotationally about its axis. The amplitude of oscillation of the oscillator plate 60 is never sufficient to cause misalignment of the holes 61 with the holes 55 to the point of closing the flow path therethrough when the valve plate openings 56 are aligned with the apertures 55; and the oscillations of the oscillator plate 60 will contribute to causing the droplets that are formed, such as, for example the droplets 22, to be of uniform size. The size of the droplets is controlled by the temperature of the melt, the characteristics of the metals being used, the height of the melt in the cylinder 52, the size of the openings 56 and 61 in the valve plate 57 and oscillator plate 60, respectively, and the amplitude and frequency of oscillation of the oscillator plate 60. Heating elements 62 are disposed in surrounding relation to the outer cylinder to maintain a controlled temperature level of the melt. Accordingly, the melt is introduced from, the crucible 64 of FIG. 11 into crucible 49 of FIG. 12 to maintain a constant level of the melt in the crucible 49 and above the height of the inner cylinder 50 so as to maintain a uniform flow rate through the openings or orifices 56 and 61, thereby assuring that the mixing and suspension activity continues at a uniform rate.

As the droplets 22 are shaken loose from the lower end of the crucible, they are introduced into a drop tower, not shown. Drop towers are well known in the art and, for example, reference is made to U.S. Pat. Nos. 2,978,742 and 3,677,669 to Bliemeister in which shot is formed by permitting the droplets to fall into water before striking an interrupting member which will impart moderate spin to the droplets while they advance under gravity so as to create a shot of spherical shape. In accordance with the present invention, the droplets may fall through air or water or other fluid quenching medium after Bliemeister, or without being interrupted and which will therefore have a tendency to create more natural tear-drop shaped pellets with a somewhat variable or non-uniform density as a result of the tungsten powder moving forwardly in the droplet or pellet as a result of the unidirectional drag.

DETAILED DESCRIPTION OF MODIFIED METHODS OF INVENTION

Figure 13:
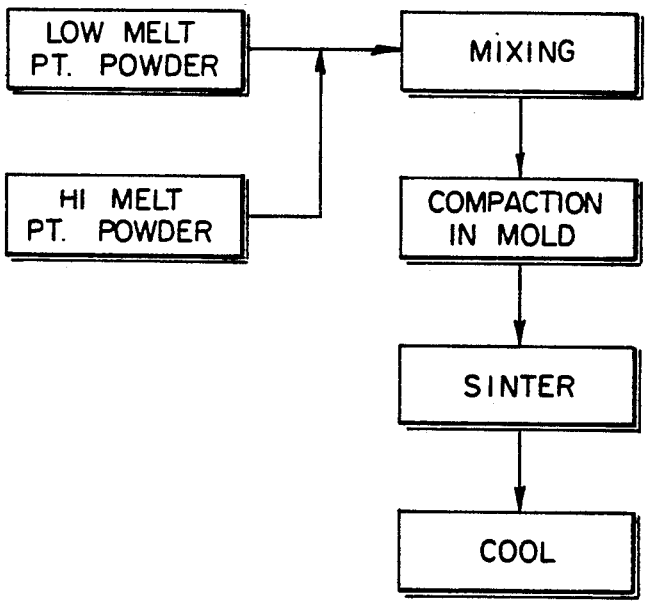
FIG. 13 is a flow diagram of a modified form of method practiced in accordance with the present invention.

FIG. 13 illustrates a powder metallurgy process practiced in accordance with the present invention in which in step 1 powders of low and high melting point metals corresponding to those described in conjunction with FIG. 1 are mixed in proper proportions, introduced into a mold of the desired product shape and subjected to compaction at a high pressure on the order of 10,000 psi or more. The product so formed is sintered to cause diffusion of the low melting point metals into one another while the high melting point metal particles remain in their original state. As a suitable alternative to the method illustrated in FIG. 13, the powders, rather than being first thoroughly mixed, may be added in any desired sequence to the compaction mold, whereupon subsequent compaction forms a desired end product with concomitant variation of density throughout the product. Again compaction will proceed followed by sintering or not as required. Any heating during sintering to a temperature slightly above the solidus temperature line does not cause the alloy to melt into a puddle as would occur with a single melting point metal. Instead, the melting will occur only in proportion to the degree to which the temperature penetrates into the melting range, as shown in FIG. 2, and the product will retain its shape under low loading. The following Tables VIII and IX are representative of compositions that may be employed in the powder metallurgy process of FIG. 13:

TABLE VIII

| | Weight Percent of: | | | |
|---|---|---|---|---|
| | Tungsten | Tin | Zinc | Density gm/cc |
| A. | 52.50 | 39.70 | 7.80 | 10.50 |
| B. | 60.30 | 33.20 | 6.60 | 11.34 |
| C. | 80.50 | 16.00 | 3.20 | 14.35 |
| D. | 89.20 | 9.00 | 1.80 | 16.19 |

TABLE IX

| | Weight Percent of: | | | |
|---|---|---|---|---|
| | Tantalum | Bismuth | Tin | Density gm/cc |
| A. | 37.90 | 47.10 | 15.00 | 10.94 |
| B. | 44.30 | 42.20 | 13.50 | 11.34 |
| C. | 73.30 | 20.20 | 6.50 | 13.58 |
| D. | 84.60 | 11.70 | 3.70 | 14.72 |

Figure 14:
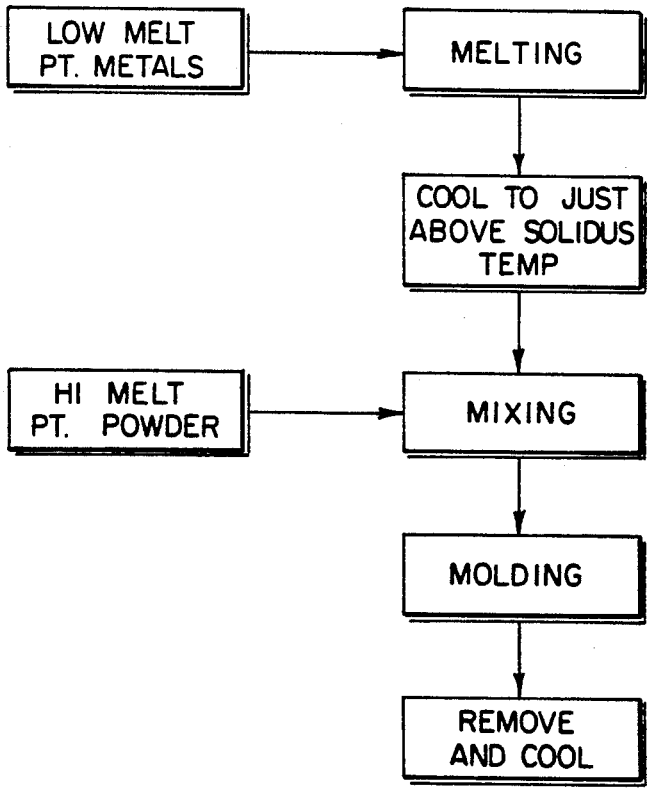
FIG. 14 is still another modified form of method practiced in accordance with the present invention.

FIG. 14 illustrates a process of molding or casting in which the low melting point metals may be combined in particle or chunk form and melted just into the complete melting range, or above the liquidus line, as described in conjunction with FIG. 1, and is then cooled to a point between the liquidus and solidus lines at which the material becomes pasty. The high melting point powder is then introduced and vigorously mixed into the pasty alloy until it is uniformly distributed throughout, as represented in step 3. Thereafter, the product is introduced into a mold, such as, a die casting mold to produce articles of the desired shape or by wire extrusion and mechanical forming. In processing, the material remains pasty rather than being a liquid, in a manner similar to wiping lead, and therefore the high density tungsten particles will not freely move under force of gravity within the product so that uniform distribution and product integrity are maintained. It will be appreciated that the methods herein described in conjunction with FIGS. 13 and 14 would be more suitable for use in the production of intricately-shaped products, such as, the bullets illustrated in FIGS. 3 to 6 and the pellets of FIGS. 9 and 10. Tables X and XI are representative of compositions that may be employed in practicing the process of FIG. 14:

TABLE X

| | Weight Percent of: | | | |
|---|---|---|---|---|
| | Tantalum | Bismuth | Zinc | Density gm/cc |
| A. | 38.60 | 51.30 | 10.10 | 10.75 |
| B. | 47.70 | 43.80 | 8.50 | 11.34 |
| C. | 73.90 | 21.80 | 4.30 | 13.48 |
| D. | 85.00 | 12.50 | 2.50 | 14.65 |

TABLE XI

| | Weight Percent of: | | | |
|---|---|---|---|---|
| | Tungsten | Lead | Tin | Density gm/cc |
| A. | 37.80 | 54.00 | 8.20 | 12.74 |
| B. | 73.20 | 23.30 | 3.50 | 15.78 |
| C. | 84.50 | 13.50 | 2.00 | 17.08 |

It will be appreciated that other casting or molding techniques can be employed to shape the alloy materials into the desired end product. For instance, spin casting by rotating a mold about a vertical axis can be employed to control distribution of the high density powder particles; or, in the alternative, rotating molds may be employed which are rotated about a horizontal axis at a precise rate to maintain the solid particles of high density powder uniformly distributed throughout the melt.

From the foregoing, the principles of the present invention are applicable to numerous products by combining a low melting matrix and high melting high density particles. Processes include adding high density particles to molten matrix metal and casting, or mixing powders of all the metals and compacting and sintering at a temperature in the low end of the melting range of the matrix alloy at which precision of temperature control is not critical, or mixing the high density particles into a paste of the matrix alloy and molding. Further, the present invention is conformable for use with low toxicity, low melting point metals in such a way as to form a matrix metal or alloy in combination with the powder of one or more low toxicity, high density, high melting point metal powders added in proportions to achieve a target density. In all processes, the low melting temperature metal or alloy may include lead or an alloy of lead for those applications where lead is an appropriate material and where densities greater than lead are needed. Further in relation to the process as herein set forth, bullets and shot can be composed in part of high density metal powders in a continuous projectile material to achieve the desired density without weakening the product. Specifically, without melting the high density metal powders they can be effectively integrated into a low melting point matrix material either by melting the matrix material and uniformly distributing the high density powder therein or by a combination of compaction and sintering so as to avoid cold welding lines that customarily exist after cold compaction and thus strengthen the product.

It is therefore to be understood that while preferred and modified forms of invention have been herein set forth and described including preferred articles of manufacture, methods of making same and preferred apparatus to be used in conjunction therewith, various modifications and changes may be made therein without departing from the spirit and scope of the present invention as defined by the appended claims.

I claim:

1. The method of making projectiles, such as, shot, bullets, pellets and the like of a predetermined density comprising the steps of:

(a) providing at least one low melting point metal having a density no greater than that of lead and less than said predetermined density;

(b) providing at least one metal in powdered form having a density greater than said predetermined density and a melting point higher than the melting point of said low melting point metal, said high melting point metal powder being present in sufficient quantities to form a resultant mixture having said predetermined density;

(c) melting said low melting point metal(s);

(d) mixing said powdered metal(s) with said low melting point metal alloy until said powdered metal(s) is uniformly distributed throughout said low melting point metal(s) in a first vessel and advancing to a second vessel; and (e) continuously heating and stirring said mixture of low melting point metal(s) and said powdered metal(s) in said second vessel and discharging in droplet form therefrom.

2. The method according to claim 1, including the step of advancing said mixture of said low melting point metal(s) and said powdered metal(s) from said first vessel to said second vessel at a rate sufficient to maintain a homogenous mixture and a constant level of said mixture in said second vessel.

3. The method according to claim 1, including the step of spinning and advancing said droplets under gravity from said second vessel through a fluid medium.

4. The method according to claim 1, said low melting point metal(s) including at least two metals that form an alloy having solidus and liquidus lines, and melting said two metals above the liquidus line.

5. The method according to claim 4, said predetermined density being the density of lead, said two metals consisting of bismuth and tin and said powdered metal consisting of tungsten.

6. The method according to claim 4, said two metals selected from the group consisting of tin, antimony, lead, zinc, bismuth, indium, copper, silver, arsenic, aluminum, cadmium, selenium and calcium.

7. The method of making projectiles, such as, shot, bullets, pellets and the like of a selected density approximating that of lead comprising the steps of:

(a) preparing a metal alloy comprised of at least two metals, each said metal having a density less than said selected density;

(b) providing at least one powdered metal having a density greater than said selected density and a melting point higher than the melting point of said metal alloy, said powdered metal being introduced in sufficient quantities to form a resultant mixture having said selected density;

(c) heating said metals of said metal alloy to a temperature level sufficient for said two metals of said alloy to melt;

(d) mixing said powdered metal with said metal alloy until said powdered metal is uniformly distributed throughout said metal alloy; and (e) forming said mixture of said metal alloy and said powdered metal into droplets.

8. The method according to claim 7, wherein said alloy is a eutectic system, and melting said mixture above a liquidus line of said eutectic system.

9. The method according to claim 7, said selected density being at least as great as the density level of lead.

10. The method according to claim 9, said powdered metal being selected from the group consisting of tungsten, tantalum, iridium, osmium, rhenium, gold and alloys thereof.

11. The method according to claim 7, said alloy comprised of any two or more metals from the group consisting of tin, antimony, bismuth, lead, zinc, indium, copper, silver, arsenic, aluminum, cadmium, selenium and calcium.

12. The method according to claim 7, step (e) including heating and stirring said mixture of said metal alloy and said powdered metal in a first vessel and advancing to a second vessel, continuously heating and stirring said mixture in said second vessel and discharging in droplet form therefrom.

13. The method according to claim 12, step (e) including advancing said mixture of said metal alloy and said powdered metal from said first vessel to said second vessel at a rate sufficient to maintain a constant level of said metal alloy and said powdered metal in said second vessel, followed by discharging said mixture in droplet form through a fluid quenching medium.

14. The method of making an article of manufacture of a predetermined density and being composed at least in part of a low density metal powder and a high density metal powder comprising the steps of:

(a) providing at least one low melting point metal powder, each said low melting point metal powder having a density less than said predetermined density so as to be no greater than the density of the lead;

(b) providing at least one high melting point metal powder having a density greater than said predetermined density;

(c) mixing said low melting point and high melting point metal powders until a homogenous mixture is formed;

(d) compacting said mixture in a mold having the configuration of said article and heating said article to a level sufficient to sinter said low melting point metal powders.

15. The method according to claim 14, step (a) including the step of providing at least two low melting point metal powders to form an alloy having a density less than that of lead, and step (d) including the step of heating said mixture to a temperature level above the solidus line of said alloy.

16. The method according to claim 15, said low melting point metal powder(s) selected from the group consisting of tin, antimony, bismuth, zinc, indium, copper, silver, arsenic, aluminum, cadmium, selenium and calcium.

17. The method according to claim 15, said high melting point metal powder(s) being selected from the group consisting of tungsten, tantalum, iridium, osmium, rhenium, gold and alloys thereof.

18. The method according to claim 14, said low melting point powder(s) including bismuth and tin and said high melting point powder(s) including tungsten.

19. The method of making an article of manufacture of a selected density comprising the steps of:

(a) melting at least two low melting point metals into a molten metal alloy having a density no greater than that of lead and having known solidus and liquidus lines;

(b) cooling said molten metal alloy to a temperature level between the solidus and liquidus lines of said alloy to achieve a desired pasty consistency;

(c) mixing at least one high melting point metal powder into said molten alloy, said high melting point metal powder(s) having a density greater than said predetermined density, said high melting point metal powder(s) being present in sufficient quantities to form a resultant mixture having said predetermined density when combined with said molten alloy;

(d) molding said resultant mixture while maintaining the temperature level of said resultant mixture above the solidus line of said alloy into the configuration of said article; and (e) cooling said resultant mixture until it hardens into the configuration of said article.

20. The method according to claim 19, said low melting point metals having a density no greater than the density of lead.

21. The method according to claim 19, step (a) including the step of providing at least two low melting point metals having a density when combined less than that of lead.

22. The method according to claim 21; said low melting point metal(s) selected from the group consisting of tin, bismuth, antimony, zinc, indium, copper, silver, arsenic, aluminum, cadmium, selenium and calcium.

23. The method according to claim 21, said high melting point metal powder(s) being selected from the group consisting of tungsten, tantalum, iridium, osmium, rhenium, gold and alloys thereof.

24. The method according to claim 19, said low melting point metal(s) including bismuth and tin and said high melting point powder(s) including tungsten.

* * * * *